US007275742B2

(12) United States Patent
Schäfer et al.

(10) Patent No.: US 7,275,742 B2
(45) Date of Patent: Oct. 2, 2007

(54) APPARATUS WITH SPRINGS FOR CONVEYING SHEETS IN A PRINTING PRESS

(75) Inventors: Thomas Schäfer, Heidelberg (DE); Steffen Siegemund, Walldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 420 days.

(21) Appl. No.: 10/890,327

(22) Filed: Jul. 13, 2004

(65) Prior Publication Data

US 2005/0035529 A1 Feb. 17, 2005

(30) Foreign Application Priority Data

Jul. 24, 2003 (DE) ..... 103 33 753

(51) Int. Cl.
*B65H 29/68* (2006.01)

(52) U.S. Cl. ..... 271/182; 271/183; 271/196; 271/197

(58) Field of Classification Search ..... 271/182, 271/183, 196, 197; 198/689.1, 817; 101/232
See application file for complete search history.

(56) References Cited

U.S. PATENT DOCUMENTS

| | | | | |
|---|---|---|---|---|
| 3,126,826 A | | 3/1964 | Fischer | |
| 3,698,706 A | * | 10/1972 | Mihojevich et al. | 271/9.11 |
| 3,724,840 A | * | 4/1973 | Kuckhermann | 271/182 |
| 4,524,963 A | * | 6/1985 | D'Angelo et al. | 271/3.12 |
| 5,259,309 A | | 11/1993 | Stiel et al. | |
| 5,863,037 A | | 1/1999 | Jost | |
| 6,299,367 B1 | | 10/2001 | Kawakami et al. | |
| 6,557,468 B2 | | 5/2003 | Kelm et al. | |
| 2002/0043758 A1 | | 4/2002 | Kelm et al. | |

FOREIGN PATENT DOCUMENTS

| | | |
|---|---|---|
| DE | 40 23 615 A1 | 3/1991 |
| DE | 42 42 606 A1 | 8/1993 |
| DE | 195 37 284 C1 | 10/1996 |
| DE | 197 13 919 C1 | 7/1998 |
| DE | 198 38 975 A1 | 3/2000 |
| DE | 101 34 836 A1 | 2/2002 |
| EP | 0 949 082 B1 | 10/1999 |
| GB | 2 340 827 A | 3/2000 |

* cited by examiner

*Primary Examiner*—Patrick Mackey
*Assistant Examiner*—Gerald W McClain
(74) *Attorney, Agent, or Firm*—Laurence A. Greenberg; Werner H. Stemer; Ralph E. Locher

(57) ABSTRACT

An apparatus for conveying sheets in a printing press makes reliable sheet guiding possible with a low outlay on material and at low cost and includes an apparatus for conveying sheets in a printing press having at least one conveyor element for a sheet along a conveying path and at least one guide element for the sheet in the conveying direction, at least one elongate spring element being provided as a guide element.

10 Claims, 4 Drawing Sheets

APPARATUS WITH SPRINGS FOR CONVEYING SHEETS IN A PRINTING PRESS

BACKGROUND OF THE INVENTION

Field of the Invention

The invention relates to an apparatus for conveying sheets in a printing press having at least one conveyor element for a sheet along a conveying path and at least one guide element for the sheet in the conveying direction.

In printing presses, it is known to convey sheets from the last printing unit onto a stack, the leading edge of the sheets being held on grippers that are fastened on a circulating chain mechanism. Before a sheet is deposited onto the stack, its conveying speed is reduced using braking modules that have suction belts that are narrow with regard to the sheet width. Thin sheets tend to sag between the braking modules. The sagging impairs the formation of stacks and can cause the corners to be folded over. The braking modules can be adjusted laterally to adapt the position transversely with respect to the conveying direction to the sheet width. The spacing between the braking modules can be of varying size. Therefore, the width of support elements that are provided to reduce the sagging between the braking modules must be adjustable.

German Published, Non-Prosecuted Patent Application DE 101 34 836 A1, corresponding to U.S. Pat. No. 6,557,468 to Kelm et al., describes a delivery for a sheet-fed printing press in which a plurality of braking devices are provided that can be adjusted transversely with respect to the sheet conveying direction. A sheet-guiding device including a belt of flexible material is disposed in the intermediate space between adjacent braking devices, it being possible to adapt the length of the belt transversely with respect to the conveying direction to the spacing of adjacent braking devices. Support of this type of a sheet using a roller blind is complicated in constructional terms because of the requirement for a roller blind tensioning mechanism and requires a large amount of installation space. In addition, the deflection and tensioning rollers used are sensitive to contamination, in particular, in deliveries in which the sheets are powdered to prevent smudging.

Furthermore, guide plates or guide loops are known as support elements, in which no measures to adjust the support width is provided. Depending on requirements, guide plates of varying width or a varying number of guide loops are used. Furthermore, it is known to provide guide plates or guide loops whose support width can be adjusted and that lie in an overlapped manner or are configured to be telescopic. Such constructions are complicated and susceptible to contamination.

SUMMARY OF THE INVENTION

It is accordingly an object of the invention to provide an apparatus for conveying sheets in a printing press that overcomes the hereinafore-mentioned disadvantages of the heretofore-known devices of this general type and that that makes reliable sheet guiding possible with a low outlay on material and at low cost.

With the foregoing and other objects in view, there is provided, in accordance with the invention, a apparatus for conveying sheets in a printing press, including at least one conveyor element for conveying a sheet along a conveying path in a conveying direction and at least one guide element for guiding the sheet in the conveying direction, the at least one guide element being at least one elongate spring element.

According to the invention, an elongate spring element is tensioned transversely or longitudinally with respect to the conveying direction as guide elements for a sheet. Helical springs whose ends are fastened to a holder are particularly suitable. To prevent back swing in the event of contact with a sheet, the ends of the helical springs can be guided in mandrels. The use of a plurality of helical springs in parallel next to one another results in virtually a support surface with punctiform contact of a sheet. Helical springs having a winding made from round wire are not sensitive to powder, are inexpensive and do not have any sharp edges that could scratch a sheet. The surfaces of the helical springs can have a special coating, over which a sheet can slide in a particularly gentle manner. The helical springs are compliant so that damping occurs if a sheet touches the helical springs abruptly. The invention can be used in machines that process, coat, inspect, or merely transport the sheet. Within the context of the invention, sheet is to be understood as meaning individual sheets, a plurality of collated sheets, or folded products.

In accordance with another feature of the invention, at least one spring element is at least one helical spring.

In accordance with a further feature of the invention, the at least one-helical spring has windings wound from round wire.

In accordance with an added feature of the invention, the at least one spring element is a plurality of helical tension springs disposed parallel to one another.

In accordance with an additional feature of the invention, there is provided a common holder, the helical tension springs each having ends respectively fastened to the common holder.

In accordance with yet another feature of the invention, there is provided a frame connected to at least one of the at least one conveyor element and the least one helical spring, the frame having mandrels fixed thereto and the least one helical spring having ends guided in the mandrels.

In accordance with yet a further feature of the invention, the at least one guide element has braking modules disposed transversely with respect to the conveying direction and the at least one helical spring is a plurality of helical springs disposed between the braking modules.

In accordance with yet an added feature of the invention, the helical springs have ends, the braking modules have positioning regions, the ends move, with the braking modules, transversely with respect to the conveying direction, and the helical springs are tensioned to substantially maintain a stretched position in a positioning region of the braking modules.

In accordance with yet an additional feature of the invention, the helical springs have ends, the braking modules have positioning regions, the ends move with the braking modules, and the helical springs are tensioned to substantially maintain a stretched position in a positioning region of the braking modules.

In accordance with again another feature of the invention, at least one conveyor element is two conveyor elements movably disposed toward one another and the at least one helical spring is a plurality of helical springs disposed between the two conveyor elements for bridging a format in the conveying direction.

With the objects of the invention in view, there is also provided an apparatus for conveying sheets in a printing press, including at least one conveyor element for conveying a sheet along a conveying path in a conveying direction, a holder, and a guide element having braking modules disposed transversely with respect to the conveying direction, tension springs for guiding the sheet in the conveying direction, the springs being disposed parallel to one another, each having ends respectively fastened to the holder, a frame connected to at least one of the at least one conveyor element and the springs, the frame having mandrels, the springs being disposed between the braking modules and having ends guided in the mandrels.

With the objects of the invention in view, in a printing press, there is also provided an apparatus for conveying sheets including at least one conveyor element for conveying a sheet along a conveying path in a conveying direction and at least one guide element for guiding the sheet in the conveying direction, the at least one guide element being at least one elongate spring element.

With the objects of the invention in view, there is also provided a In a printing press, an apparatus for conveying sheets including at least one conveyor element for conveying a sheet along a conveying path in a conveying direction, a holder, and a guide element having braking modules disposed transversely with respect to the conveying direction, tension springs for guiding the sheet in the conveying direction, the springs being disposed parallel to one another and each having ends respectively fastened to the holder, a frame connected to at least one of the at least one conveyor element and the springs, the frame having mandrels, and the springs being disposed between the braking modules and having ends guided in the mandrels.

Other features that are considered as characteristic for the invention are set forth in the appended claims.

Although the invention is illustrated and described herein as embodied in an apparatus for conveying sheets in a printing press, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
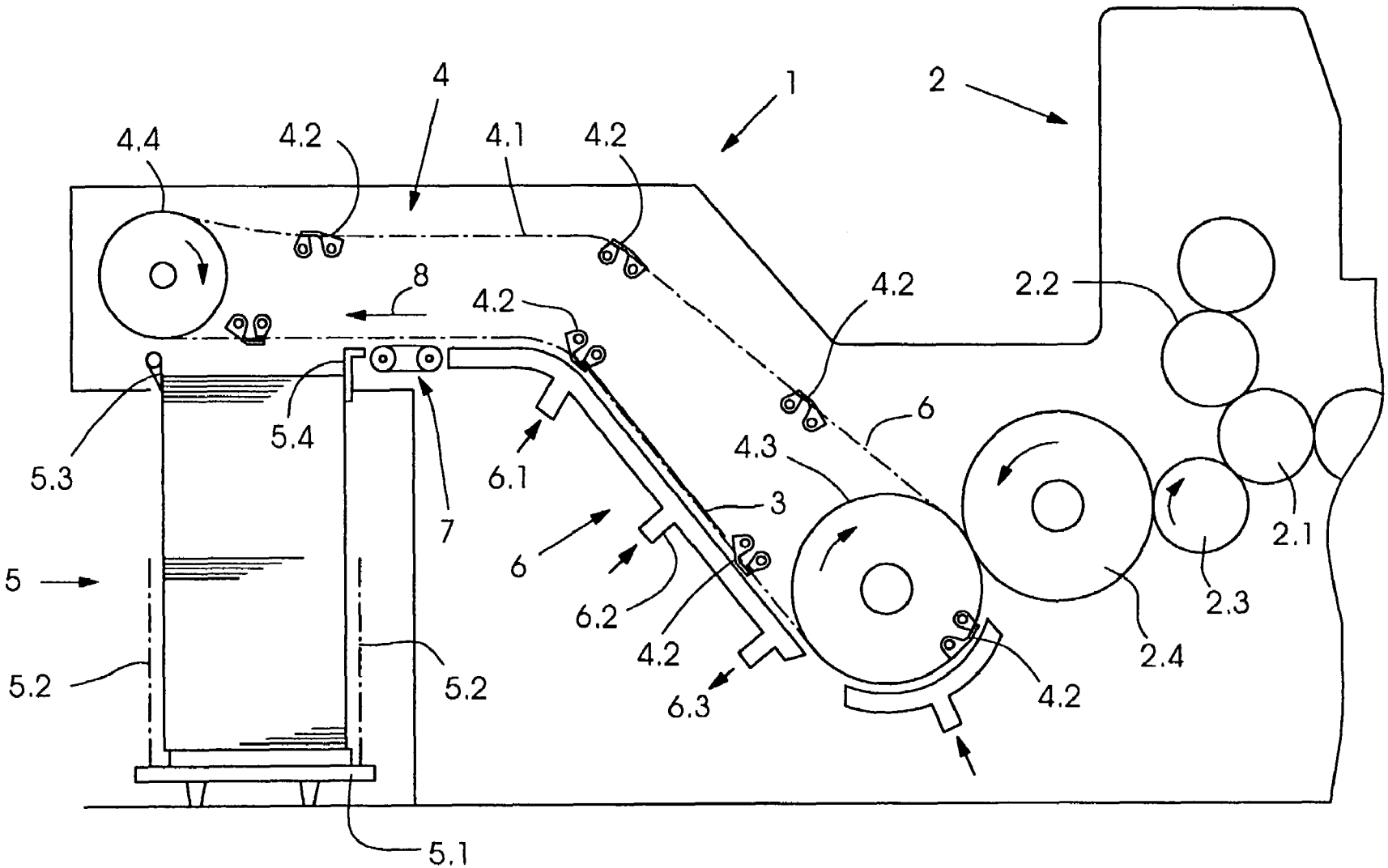
FIG. 1 is a fragmentary, cross-sectional diagrammatic view of a delivery of a printing press according to the invention having a braking station for sheets.

Referring now to the figures of the drawings in detail and first, particularly to FIG. 1 thereof, there is shown a delivery 1 connected behind (downstream of) a printing unit 2. The printing unit 2 includes an impression cylinder 2.1, a blanket cylinder 2.2, a single revolution transfer drum 2.3, and a half-revolution transfer drum 2.4. Sheets 3 are transported individually one after another from the printing unit 2 to a stacking device 5 by a chain conveyor 4. The stacking device 5 has a platform 5.1 and lifting chains 5.2; furthermore, it has a leading edge stop 5.3 and a trailing edge stop 5.4. Inter alia, the chain conveyor 4 includes conveyor chains 4.1, gripper bars 4.2, drive sprockets 4.3, and deflection sprockets 4.4. A hollow sheet guiding apparatus 6 is provided in the rising region of the chain delivery 1. It has two inlet stubs 6.1, 6.2 and an outlet stub 6.3 for supplying and discharging blown air. On its side that faces the sheet 3, it is provided with blowing nozzles that are not shown in FIG. 1. Furthermore, the delivery 1 includes a braking device 7, which will be described in yet more detail in the following text.

Figure 2:
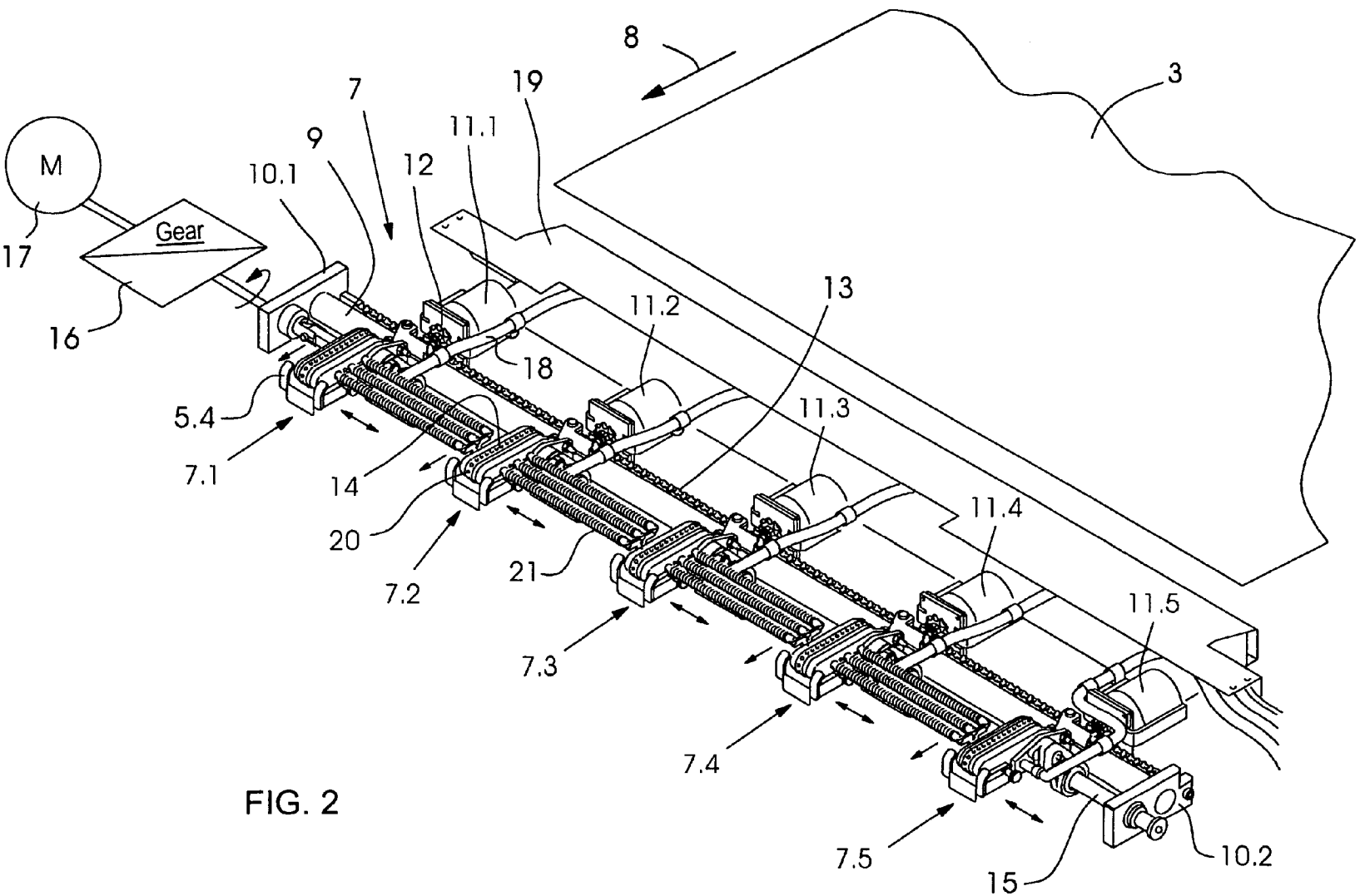
FIG. 2 is a fragmentary, perspective view of a braking station according to the invention having helical springs as support elements for sheets.

The braking station 7 shown in FIG. 2 includes five suction belt modules 7.1 to 7.5 in a parallel configuration with respect to the conveying direction 8 of the sheets 3. The suction belt modules 7.1 to 7.5 can be positioned transversely with respect to the conveying direction 8 individually onto print-free regions of the sheet 3. For such a purpose, the suction belt modules 7.1 to 7.5 are mounted on a guide rod 9 that is fastened in a frame 10.1, 10.2. Stepping motors 11.1 to 11.5 that are coupled to the suction belt modules 7.1 to 7.5 are provided as positioning drives. Pinions 12 are disposed on the drive shafts of the stepping motors 11 in each case so as to rotate with the stepping motors 11, the pinions 12 engaging in a chain 13 whose ends are fastened in the frame 10.1, 10.2 and that is oriented parallel to the guide rod 9. The suction belt modules 7.1 to 7.5 include suction belts 14 that are guided over deflection rollers. The suction belts 14 are driven synchronously, in that in each case one deflection roller is coupled to a shaft 15 that is rotatably mounted in the frame 10.1, 10.2. The shaft 15 is coupled to a gear mechanism 16 and a motor 17. Below the suction belts 14 there are suction ducts that are connected to a vacuum source through lines 18. The lines 18 are movably routed in a tube duct 19. The trailing edge stops 5.4 are fastened to the suction belt modules 7. The entire braking station 7 described in FIG. 2, including the suction belt modules 7.1 to 7.5, can be positioned in the conveying direction 8 in the deliver 11 for adaptation to various length formats of the sheets 3. The suction belts 14 have vacuum openings 20. When a sheet 3 is guided over the suction belts 14 using a gripper bar 4.2, it is held on the suction belts 14 by the effect of vacuum. Thin sheets 3, in particular, sag between the suction belt modules 7.1 to 7.5. Three helical tension springs 21 are disposed in each case between adjacent suction belt modules 7.1 to 7.5 to support sagging sheets 3. The helical tension springs 21 lie in each case parallel to one another in a plane 22 below a supporting plane 23 for the sheets 3 on the suction belts 14.

Figure 3C:
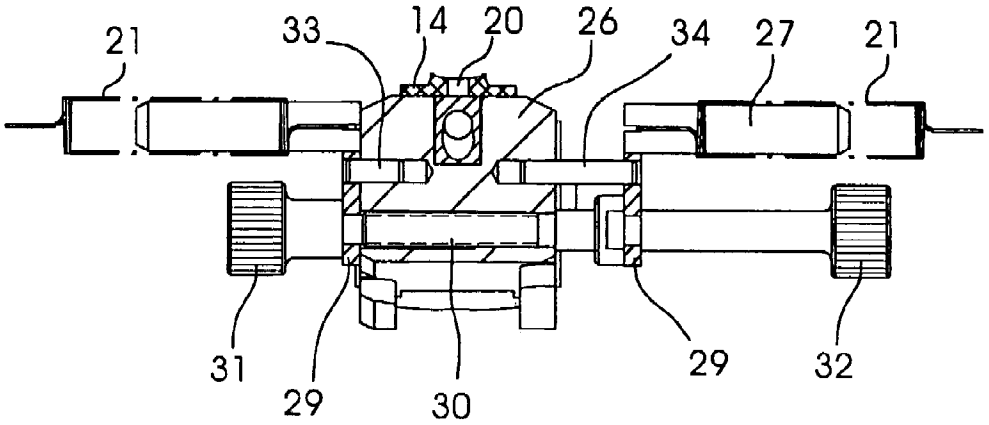
FIG. 3C is a cross-sectional view from an end of the suspension of helical springs of FIG. 3A.
Figure 3B:
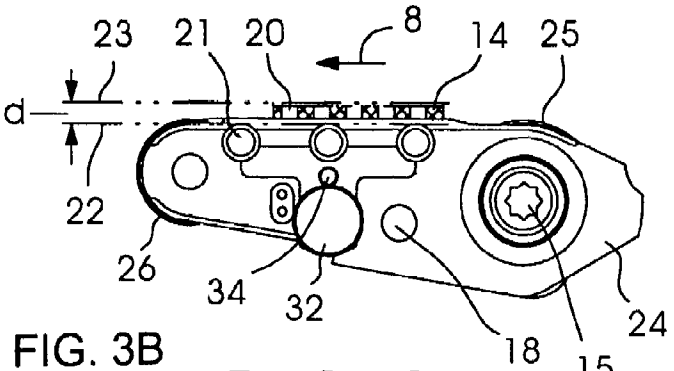
FIG. 3B is a cross-sectional view from a side of the suspension of the helical springs of FIG. 3A.
Figure 3A:
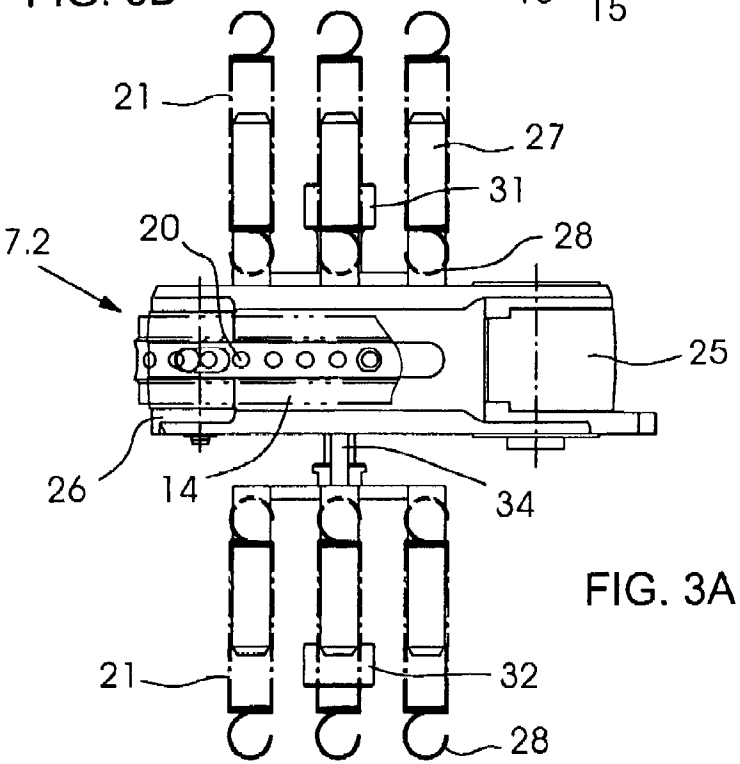
FIG. 3A is a plan and partially hidden view of a braking station according to the invention with a suspension of helical springs on holders having mandrels.

The three views in FIGS. 3A to 3C show, in greater detail, how the helical tension springs 21 are suspended on both sides of the suction belt module 7.2. A suction belt module 7.1 to 7.5 includes a basic body 24 in which two deflection rollers 25, 26 for a suction belt 14 are mounted. The deflection roller 25 is driven through the shaft 15. The ends of three helical tension springs 21 are guided through mandrels 27 and suspended on the mandrels 27 with hookshaped eyes 28. The mandrels 27 sit on holders 29. A threaded bolt 30 that projects out of the basic body 24 on both sides is provided to fasten the holders 29. The holders 29 are screwed to the threaded bolt 30 using knurled nuts 31, 32. Locating pins 33, 34 secure the rotary position of the holders 29 on the threaded bolt 30 and the spacing d of the support surface of the helical tension springs 21 from the suction belt plane 23. The spacing d simultaneously defines the maximum sagging of a sheet 3.

Figure 4:
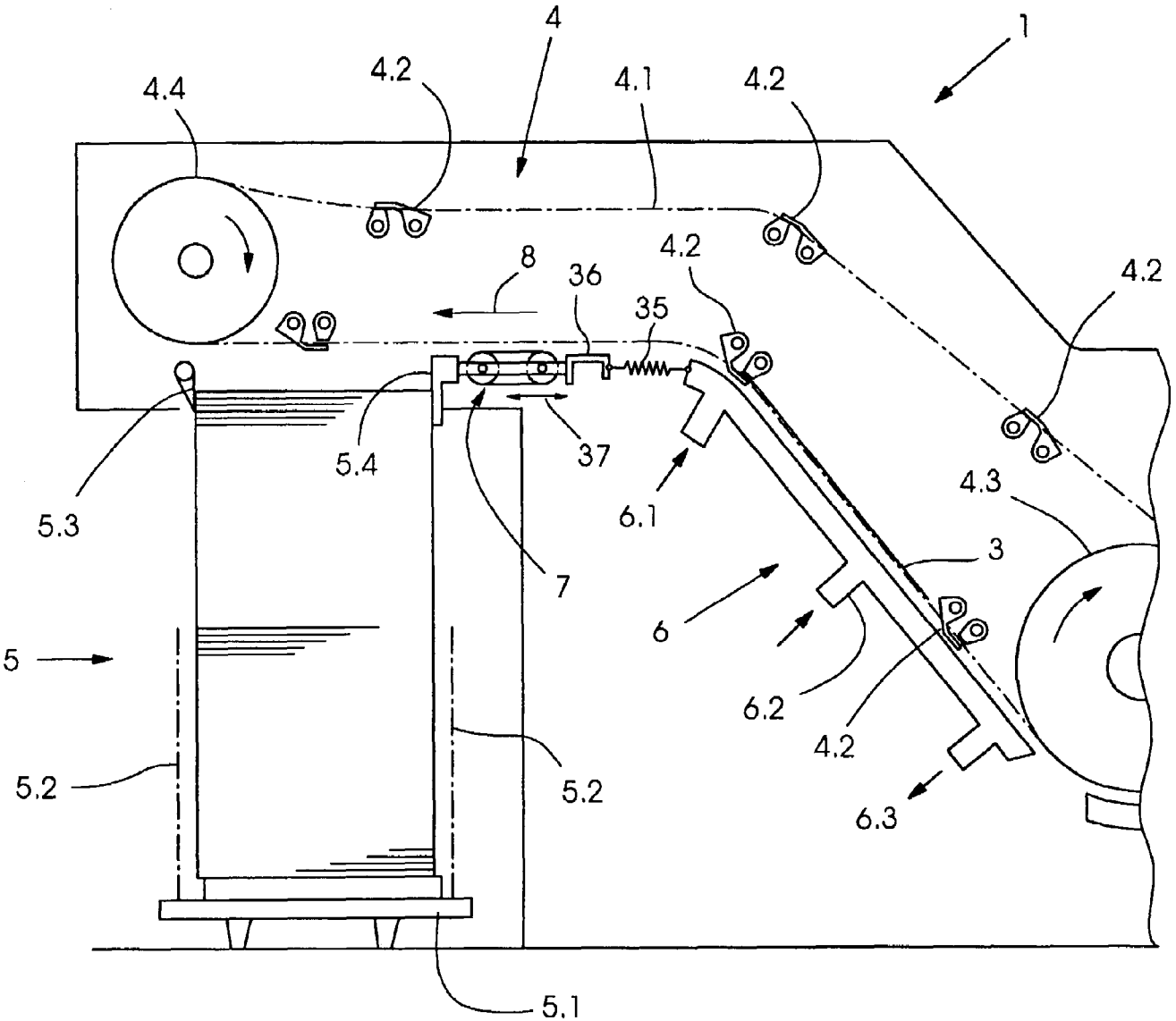
FIG. 4 is a fragmentary, perspective view of a braking station according to the invention as measures to bridge the format.

FIG. 4 shows an exemplary embodiment in which tension springs 35 are provided for bridging the format. A multiplicity of parallel tension springs 35 is disposed across the width of the sheets 3 in the conveying direction 8. One end of the tension springs 35 is fastened to the sheet-guiding device 6 and the other end is fastened to a planar guide element 36. The guide element 36 is coupled to the braking device 7. When, for adjustment to a new web length format, the braking device 7 and the trailing edge stop 5.4 are positioned horizontally in the conveying direction 8, as specified by the double arrow 37, the guide element 36 and the tension springs 35 fastened to it are carried along with them. The tension springs 35 are extended in the conveying direction 8 to a greater or lesser degree and form a supporting surface for the sheets 3 in the region between the sheet guiding apparatus 6 and the guide element 36. It is possible to fasten the ends of the tension springs 35 directly to the braking device 7, leaving out the guide element 36.

This application claims the priority, under 35 U.S.C. § 119, of German patent application No. 103 33 753.9, filed Jul. 24, 2003; the entire disclosure of the prior application is herewith incorporated by reference.

We claim:

1. An apparatus for conveying sheets in a printing press comprising:

at least one conveyor element for conveying a sheet along a conveying path in a conveying direction; and at least one guide element for guiding the sheet in said conveying direction, said at least one guide element being at least one elongate spring element, said at least one guide element having braking modules disposed transversely with respect to said conveying direction, and said at least one elongate spring element being a plurality of helical springs disposed between said braking modules.

2. The apparatus according to claim 1, wherein said helical springs have windings wound from round wire.

3. The apparatus according to claim 1, wherein said plurality of helical tension springs are disposed parallel to one another.

4. The apparatus according to claim 3, further comprising a common holder, said helical tension springs each having ends respectively fastened to said common holder.

5. The apparatus according to claim 1, further comprising:

a frame connected to at least one of said at least one conveyor element and said helical springs, said frame having mandrels fixed thereto; and said helical springs having ends guided in said mandrels.

6. The apparatus according to claim 1, wherein:

said helical springs have ends;

said braking modules have positioning regions;

said ends move with said braking modules, transversely with respect to said conveying direction; and said helical springs are tensioned to substantially maintain a stretched position in a positioning region off said braking modules.

7. The apparatus according to claim 1, wherein:

said helical springs have ends;

said braking modules have positioning regions;

said ends move with said braking modules; and said helical springs are tensioned to substantially maintain a stretched position in a positioning region of said braking modules.

8. An apparatus for conveying sheets in a printing press, comprising:

at least one conveyor element for conveying a sheet along a conveying path in a conveying direction;

a holder; and a guide element having:

braking modules disposed transversely with respect to said conveying direction;

tension springs for guiding the sheet in said conveying direction, said springs:

being disposed parallel to one another; and each having ends respectively fastened to said holder;

a frame connected to at least one of said at least one conveyor element and said springs, said frame having mandrels; and said springs being disposed between said braking modules and having ends guided in said mandrels.

9. In a printing press, an apparatus for conveying sheets comprising:

two conveyor elements for conveying a sheet along a conveying path in a conveying direction, said two conveyor elements being movably disposed toward one another; and at least one guide element for guiding the sheet in said conveying direction, said at least one guide element being at least one elongate spring element being a plurality of helical springs disposed between said two conveyor elements for bridging a format in said conveying direction.

10. In a printing press, an apparatus for conveying sheets comprising:

at least one conveyor element for conveying a sheet along a conveying path in a conveying direction;

a holder; and a guide element having:

braking modules disposed transversely with respect to said conveying direction;

helical tension springs for guiding the sheet in said conveying direction, said springs:

being disposed parallel to one another; and each having ends respectively fastened to said holder;

a frame connected to at least one of said at least one conveyor element and said springs, said frame having mandrels; and said springs being disposed between said braking modules and having ends guided in said mandrels.

* * * * *